United States Patent [19]

Legg et al.

[11] Patent Number: 4,485,590

[45] Date of Patent: Dec. 4, 1984

[54] DOOR AND FRAME MOLDED OF FIBROUS MINERAL MATERIAL

[75] Inventors: Wesley E. Legg, Bexley; Russell L. Ault, Newark; Richard A. Mott, Alexandria; Alan R. Leewood, Newark, all of Ohio

[73] Assignee: Owens-Corning Fiberglas Corporation, Toledo, Ohio

[21] Appl. No.: 460,324

[22] Filed: Jan. 24, 1983

[51] Int. Cl.[3] ..... E06B 3/00

[52] U.S. Cl. ..... 49/501; 49/504; 428/74; 428/76; 428/137; 428/285

[58] Field of Search ..... 49/501, 504; 65/44; 428/74, 75, 137, 75, 76, 285

[56] References Cited

U.S. PATENT DOCUMENTS

| | | | |
|---|---|---|---|
| 2,782,465 | 2/1957 | Palmer, Jr. | 428/74 X |
| 2,871,056 | 1/1959 | Levitt | 49/501 X |
| 2,970,347 | 2/1961 | Massopust | 49/501 |
| 3,250,041 | 5/1966 | Anger | 49/501 |
| 3,732,646 | 5/1973 | Horvay et al. | 49/501 X |
| 4,201,247 | 5/1980 | Shannon | 65/4.4 X |

*Primary Examiner*—Philip C. Kannan

*Attorney, Agent, or Firm*—Ted C. Gillespie; Paul J. Rose; Ronald C. Hudgens

[57] ABSTRACT

A door and frame molded of glass wool and a binder and having polyester resin impregnated into outer surface portions.

6 Claims, 4 Drawing Figures

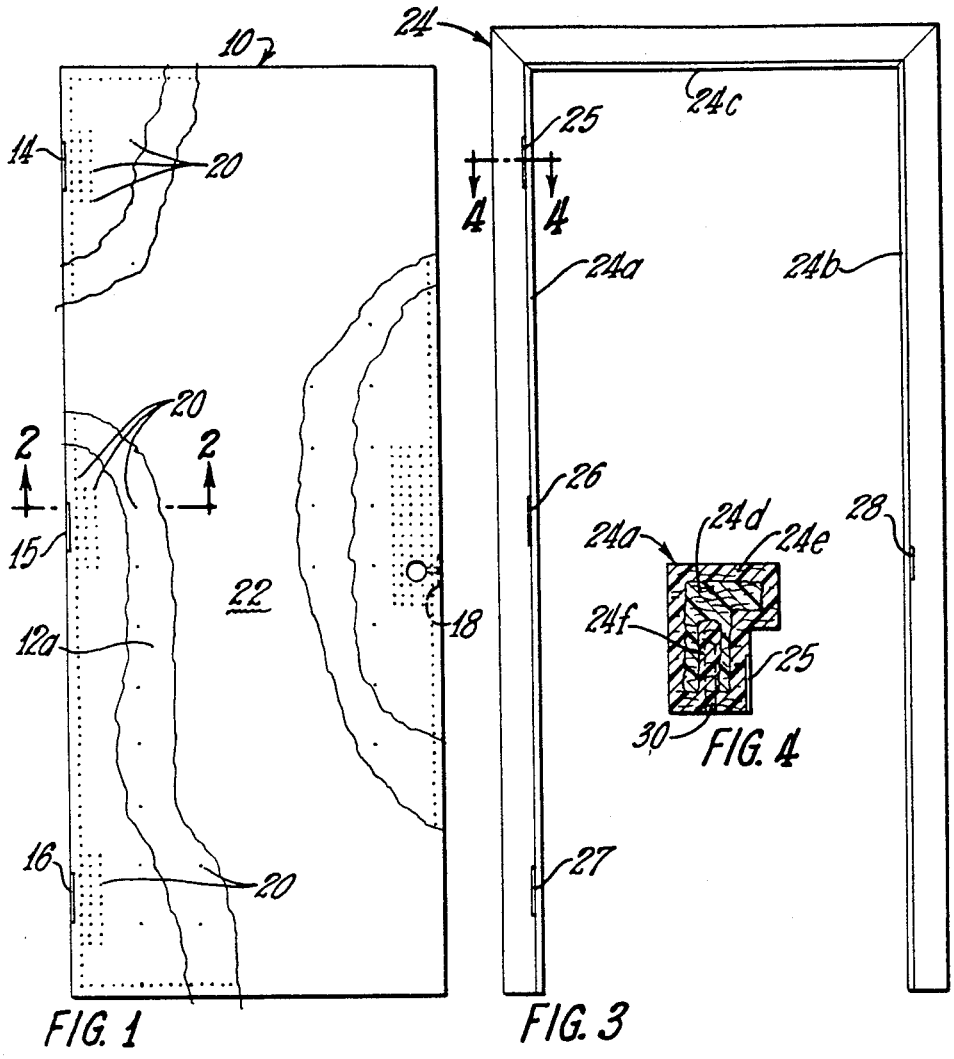
FIG. 1
FIG. 3
FIG. 4
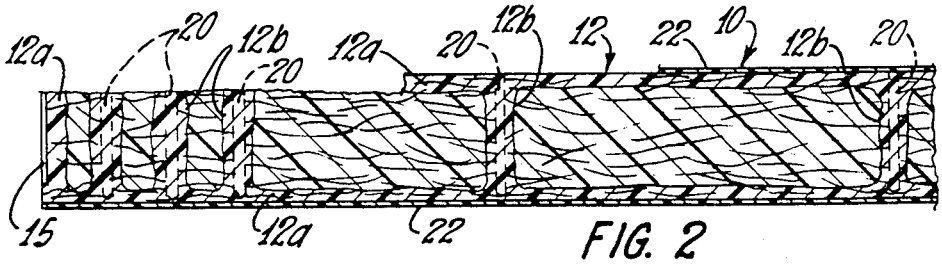
FIG. 2

DOOR AND FRAME MOLDED OF FIBROUS MINERAL MATERIAL

TECHNICAL FIELD

This invention relates generally to doors of the type used at entrances of houses, and more particularly, to such doors and frames molded of fibrous mineral material.

BACKGROUND ART

Residential entrance doors are generally made out of wood. Increasing energy costs are creating a market for more thermally resistant doors than wood. Plastic foam doors encased in steel are highly conductive at the edges.

U.S. Pat. No. 1,867,575 discloses molding a door out of cellulose fibers.

DISCLOSURE OF THE INVENTION

In accordance with the invention, a door and frame molded of fabricated fibrous mineral material such as mineral, glass, slag, or rock wool and a binder is provided.

BRIEF DESCRIPTION OF THE DRAWINGS

The invention is more fully described hereinafter, reference being had to the accompanying drawings in which:

FIG. 1 is an elevational view of a door constructed in accordance with the invention, with portions broken away;

FIG. 2 is a fragmentary sectional view taken generally along the line 2—2 of FIG. 1;

FIG. 3 is an elevational view of a door frame constructed in accordance with the invention; and FIG. 4 is a sectional view taken generally along the line 4—4 of FIG. 3.

BEST MODE OF CARRYING OUT THE INVENTION

With reference to the drawings, FIGS. 1 and 2 show a door 10 constructed in accordance with the invention and including a core or main body portion 12 molded of fabricated fibrous mineral material, preferably glass wool impregnated with about 20% by weight of a phenolic resin binder such as phenol-urea-formaldehyde, to a density of from 6 to 20, preferably about 10, pounds per cubic foot.

The core 12 is machined for reception of hinge plates, as at areas indicated by numerals 14, 15 and 16, and is machined for a doorknob, latch, and lock assembly, as at an area indicated by numeral 18. Holes 20 are drilled in the core, completely or nearly therethrough, in rows spaced about six inches apart, and all around the edges at about one-inch intervals, and in rows spaced about one-inch apart in the hinge and doorknob-latch-lock areas.

Polyester resin is applied by brushing or spraying resin on the core 12 or by dipping the core 12 in a tank full of resin. The resin soaks into the core 12 to produce a reinforced resin skin 12*a* adjacent all outer surfaces of the core and to produce reinforced resin columns 12*b* at all holes 20. Control of the penetration of the resin into the core 12 can be accomplished by varying the density of the core 12, modifying the viscosity of the resin, controlling the gel time, or varying the length of time that the core 12 is exposed to the resin. Deep penetration around the edges provides strength and allows the door to be trimmed if necessary, with the same tools as used for wood.

Any suitable finish coat 22 may be applied over the resin-treated core 12. The coat 22 may be a pigmented gel coat, paint, or a veneer of plastic, metal, or wood.

FIGS. 3 and 4 show a frame 24 provided to complement the door 10. The frame 24 comprises side members 24*a* and 24*b* and a top member 24*c* all identical in cross section, opposite ends of the top member 24*c* being mitered respectively to upper ends of the side members 24*a* and 24*b*. The side member 24*a* is notched at areas identified by numerals 25, 26, and 27 for reception of hinge plates, and the side member 24*b* is notched at an area identified by numeral 28 for reception of a latch plate. The frame 24 is made similarly to the door 10. Each of the members 24*a*, 24*b*, and 24*c* includes a core, such as core 24*d* for the member 24*a*, molded of fabricated fibrous mineral material, preferably glass wool, impregnated with a phenolic resin binder such as phenol-urea-formaldehyde, and subsequently treated with polyester resin which penetrates the core to produce a reinforced resin skin such as 24*e* adjacent outer surfaces of the core. Holes such as the hole 30 may be drilled out before application of the polyester resin, whereby reinforced resin columns such as the column 24*f* may be produced to strengthen the member 24*a* at the hinge plate areas 25, 26, and 27 and the member 24*b* at the latch plate area 28.

Various modifications may be made in the structure shown and described without departing from the scope of the invention as set forth in the following claims.

We claim:

1. A door comprising fabricated fibrous mineral material impregnated with a binder resin, molded into the shape of a door, provided in selected hinge, doorknob, and lock areas with a plurality of spaced holes extending at least most of the way therethrough from one side thereof, and further impregnated on outer surfaces thereof with resin in addition to the binder resin, the additional resin filling said holes and impregnating the molded mineral material adjacent said holes.

2. A door as claimed in claim 1 wherein the fibrous mineral material is glass wool.

3. A door as claimed in claim 1 wherein the binder resin is phenol-urea-formaldehyde.

4. A door as claimed in claim 1 wherein the additional resin is polyester resin.

5. A door as claimed in claim 1 wherein the density of the molded fibrous mineral material is from six to twenty pounds per cubic foot.

6. A door as claimed in claim 1 wherein the density of the molded fibrous mineral material is about ten pounds per cubic foot.

* * * * *